US006328574B1

(12) United States Patent
Howell et al.

(10) Patent No.: US 6,328,574 B1
(45) Date of Patent: Dec. 11, 2001

(54) HIGH CURRENT CAPACITY SOCKET WITH SIDE CONTACTS

(75) Inventors: David G. Howell, Gilbert, AZ (US); Yu Hsu Lin, San Jose, CA (US); Pei-Lun Sun, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/917,380

(22) Filed: Jul. 27, 2001

(51) Int. Cl.[7] ..... H01R 12/00
(52) U.S. Cl. ..... 439/70; 439/69
(58) Field of Search ..... 439/68, 69, 70, 439/72, 55, 722

(56) References Cited

U.S. PATENT DOCUMENTS 3,805,117 * 4/1974 Hausman ..... 439/72
5,647,121 * 7/1997 McLellan et al. ..... 439/70
6,210,175 * 4/2001 Payne ..... 439/69

* cited by examiner

*Primary Examiner*—Tho D. Ta
(74) *Attorney, Agent, or Firm*—Wei Te Chung

(57) ABSTRACT

A high current capacity socket (1) comprises a base (10) and a number of side contacts (20). The base includes a bottom plate (100), a pair of sidewalls (101) extending upwardly from opposite sides of the bottom plate. A number of passageways (102) are defined in the bottom plate and corresponding terminals (11) are received in the passageways. A receiving room (104) is defined in the center of the bottom plate. The side contacts are fixed in the sidewall (101) of the base (10) to transmit current to a printed circuit board or grounded to reduce the dimension of an integrated circuit package that is received in the receiving room.

19 Claims, 8 Drawing Sheets

HIGH CURRENT CAPACITY SOCKET WITH SIDE CONTACTS

BACKGROUND OF THE INVENTION

1. Field of the Invention

The present invention is generally related to a high current capacity socket, and more particular to a high current capacity socket with side contacts fixed on side walls of the socket.

2. Description of the related art

High current capacity socket is used to transmit signals and carry current between a printed circuit board and an integrated circuit package. Such a high current capacity socket for receiving an integrated circuit package includes an insulative base defining a number of passageways therein and corresponding terminals received in the passageways respectively. The integrated circuit package has a plurality of pins extending from the integrated circuit package downwardly and received into the passageways to engage with the terminals. Pins to transmit the signals and pins to carry current and also a number of grounding pins are all mounted on the integrated circuit package. Accordingly, the passageways in the base of the socket must receive all the pins. A related art is shown in FIG. 8, a conventional CPU socket 6 for receiving a CPU 7 includes an insulative base 61 defining a number of passageways 611 and a plurality of terminals 63 received in the passageways 611 wherein the terminals 63 involve signal terminals, current terminals and grounding terminals. This will inevitably enlarge size of the CPU 7, thus, size of the CPU socket 6 should be enlarged accordingly. As a result, manufacture of the socket will be more difficult and the socket will occupy more space on a circuit board.

Hence, an improved high capacity socket is required to overcome the disadvantages of the prior art.

BRIEF SUMMARY OF THE INVENTION

Therefore, an object of the present invention is to provide a high current capacity socket having side contacts fixed on a sidewall of the socket.

Another object of the present invention is to provide a high current capacity socket having side contacts to transmit current and grounding of the socket.

To achieve the above-mentioned objects, a high current capacity socket to receive an integrated circuit package having a number of pins extending downwardly thereof comprises a base and a number of side contacts. The base has a bottom plate, a number of passageways defined on the bottom plate, a sidewall extending upwardly from the bottom plate, a receiving room defined in the center of the bottom plate for receiving the integrated circuit package and a number of terminals received in the passageways. The side contacts are secured to the sidewall for engaging with the conductive spots of the integrated circuit package. Each of the side contacts has a connecting portion, a number of finger-like arms and a number of solder pads corresponding to the arms. The arms each have a dimple thereon. The integrated circuit package has an insulative housing. A number of circuit paths are formed in the insulative housing electrically engaging with a number of pins and a chip-module packaged in the insulative housing. The pins extend vertically from the integrated circuit package for inserting into the passageways. Some of the circuit paths exposed at a side of the insulative housing and form conductive spots. When the integrated circuit package is received into the receiving room of the bottom plate, the pins of the integrated circuit package will be inserted into the passageways to engage with the terminals. The dimples of the side contacts engage with the conductive spots that are exposed out of the insulative housing. In another embodiment, the base has another sidewall extending upwardly from the bottom plate of the base opposite to the one sidewall.

Other objects, advantages and novel features of the invention will become more apparent from the following detailed description of the present embodiment when taken in conjunction with the accompanying drawings.

DETAILED DESCRIPTION OF THE INVENTION

Figure 1:
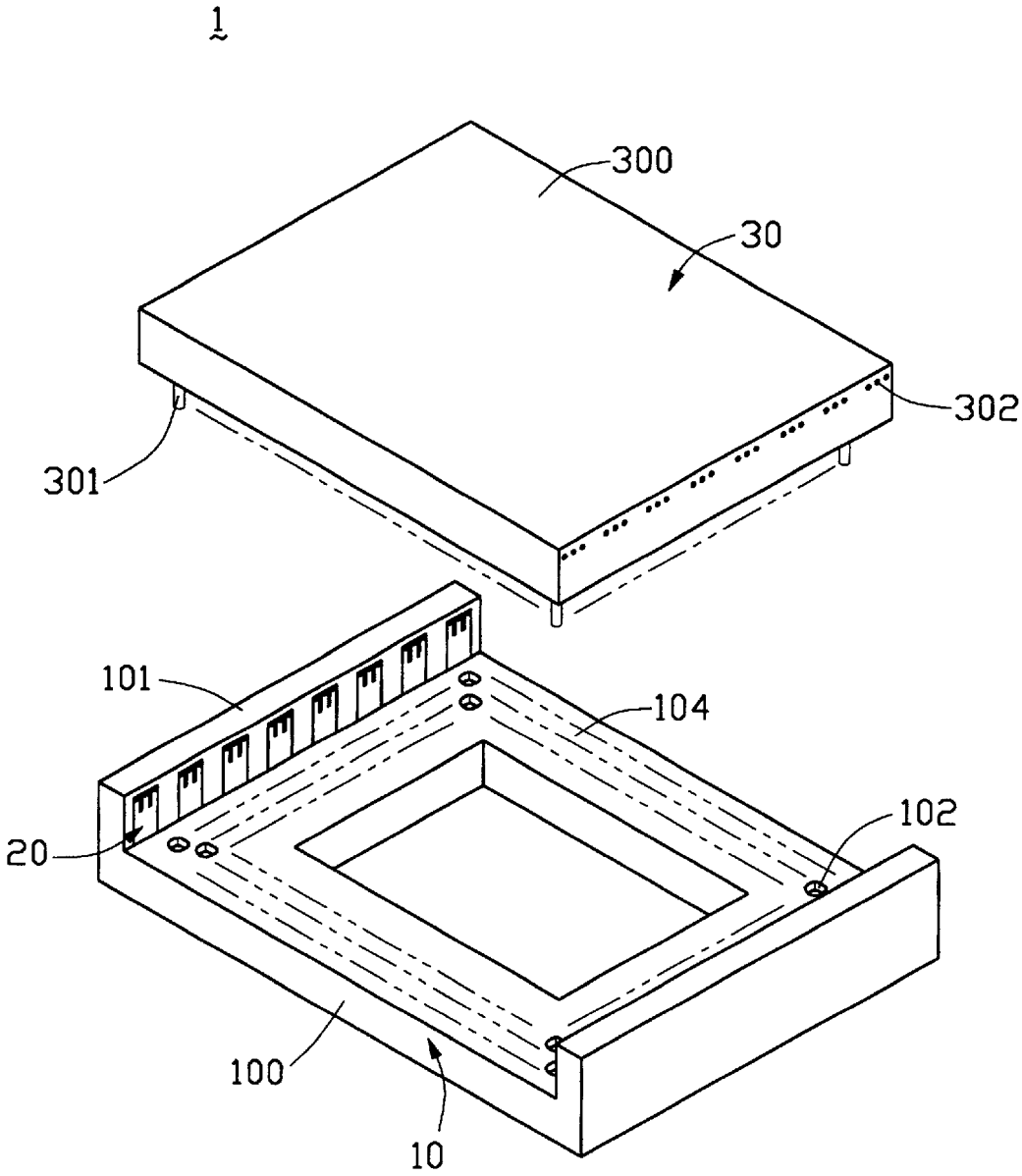
FIG. 1 is an exploded view of a high current capacity socket in accordance with the present invention.

Referring to FIG. 1, a high current capacity socket 1 in accordance with the present invention includes a base 10 and a number of side contacts 20. The base 10 has a bottom plate 100 and a pair of sidewalls 101 extending upwardly from opposite sides of the bottom plate 10. A number of passageways 102 are defined in the bottom plate 10 and a number of terminals 11 (shown in FIG. 4) are received in corresponding passageways 102. The sidewalls 101 and the bottom plate 100 define a receiving room 104 to receive an integrated circuit package 30 having a plurality of pins 301 extending downwardly.

Figure 2:
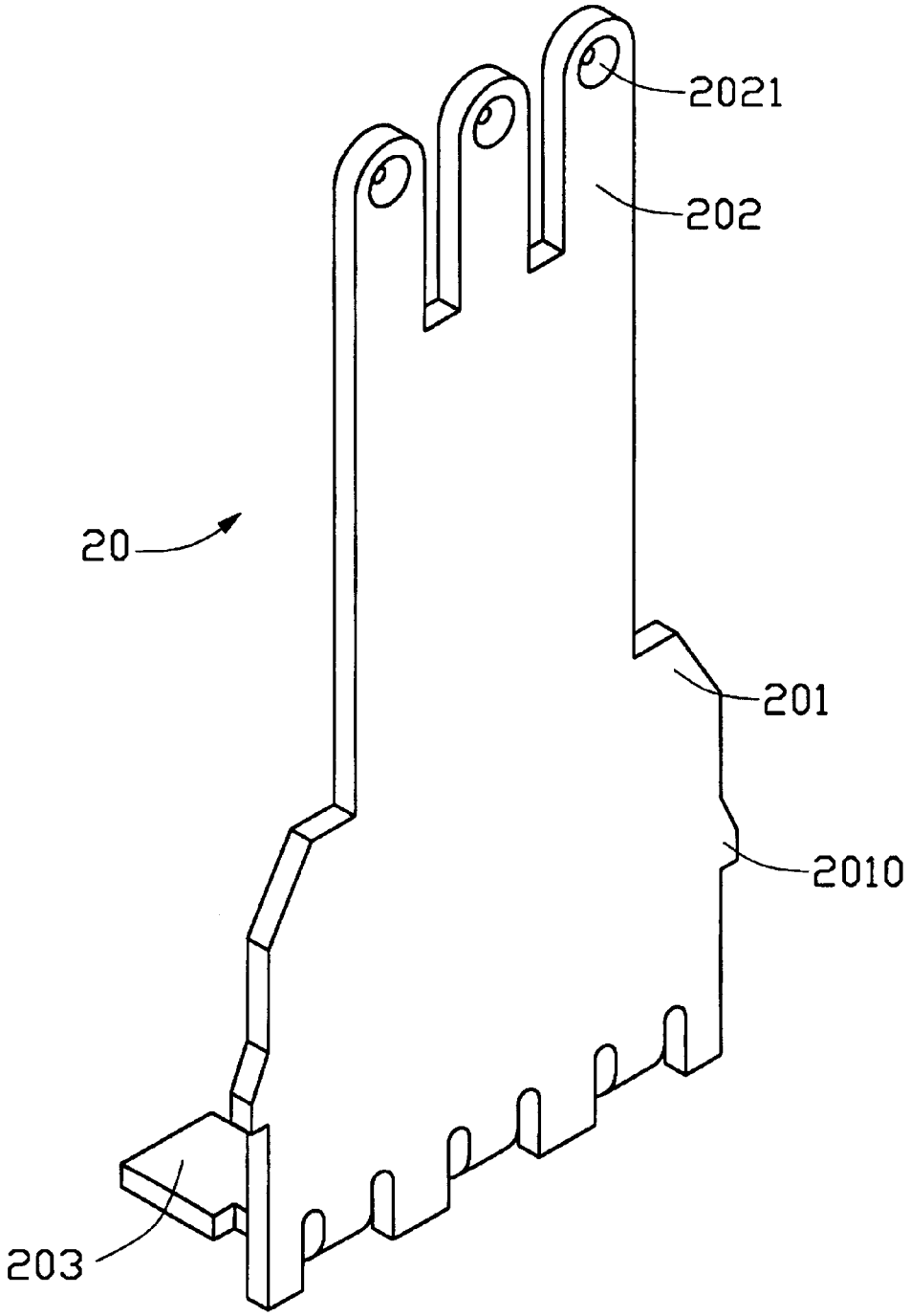
FIG. 2 shows a side contact in accordance with the present invention.

Referring to FIG. 2, each of the side contact 102 has a connecting portion 201, three finger-like arms 202 extending upwardly from the connecting portion 201 and three solder pads 203 corresponding with the arms 202. Each of the arms 202 defines a dimple 2021 at a top end thereof. A pair of barbs 2010 are defined on opposite sides of the connecting portion 201 to secure the side contacts 20 in the sidewalls 101 of the base 10.

Figure 3:
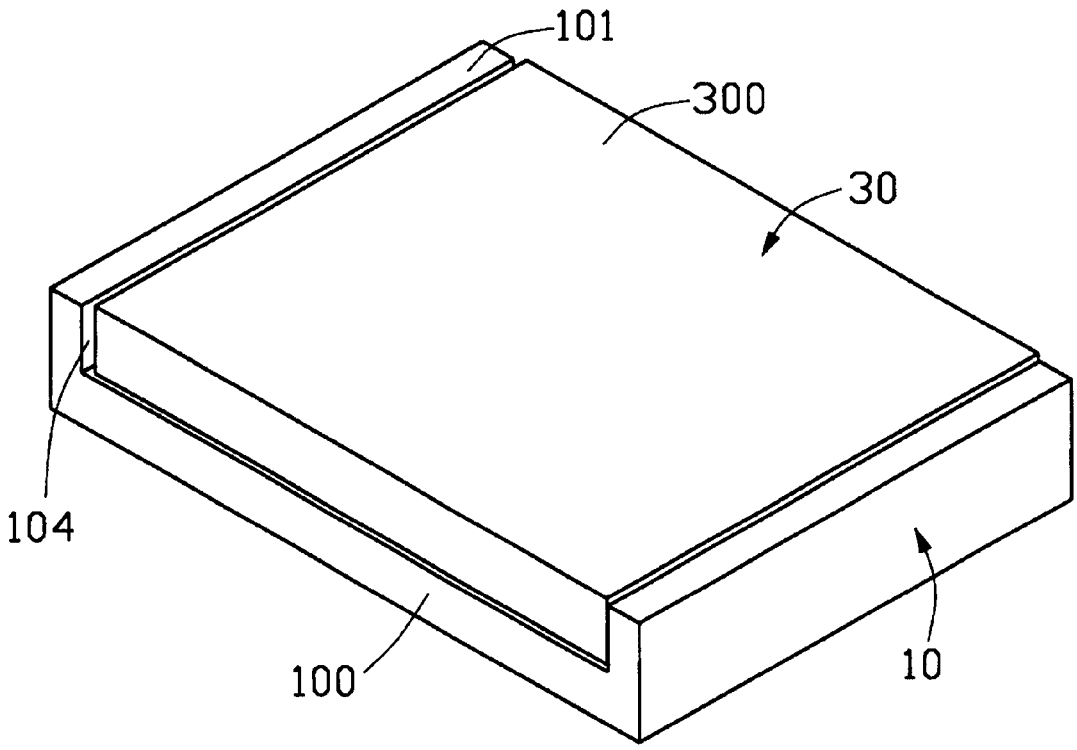
FIG. 3 an perspective view of the high current capacity socket in accordance with the present invention.
Figure 4:
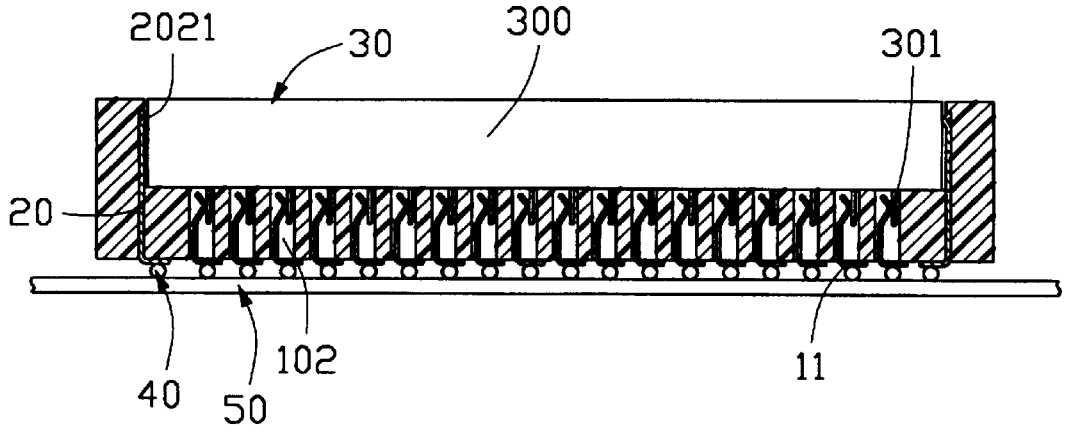
FIG. 4 is a cross section of the high current capacity socket in accordance with the present invention.

Referring to FIGS. 1, 3 and 4, the integrated circuit package 30 to be received in the receiving room 104 includes an insulative housing 300, a chip-module (not shown) and a number of circuit paths (not shown) packaged in the insulative housing 300. A number of conductive spots 302 expose at sides of the insulative housing 300 to electrically connect with the dimples 2021 of the side contacts 20. The chip-module and the number of conductive spots 302 are electrically connected via the number of circuit paths packaged in the insulative housing 300. The integrated circuit package 30 is inserted in the receiving room 104 and the pins 301 are received in the passageways 102 to connect with terminals 11. By this arrangement, the conductive spots 302 are ensured to engage with the dimples 2021 of the side contacts 20. Each of the solder pads 203 has a solder ball 40 thereunder to transmit current to the printed circuit board 50 or for grounding purpose.

Figure 5:
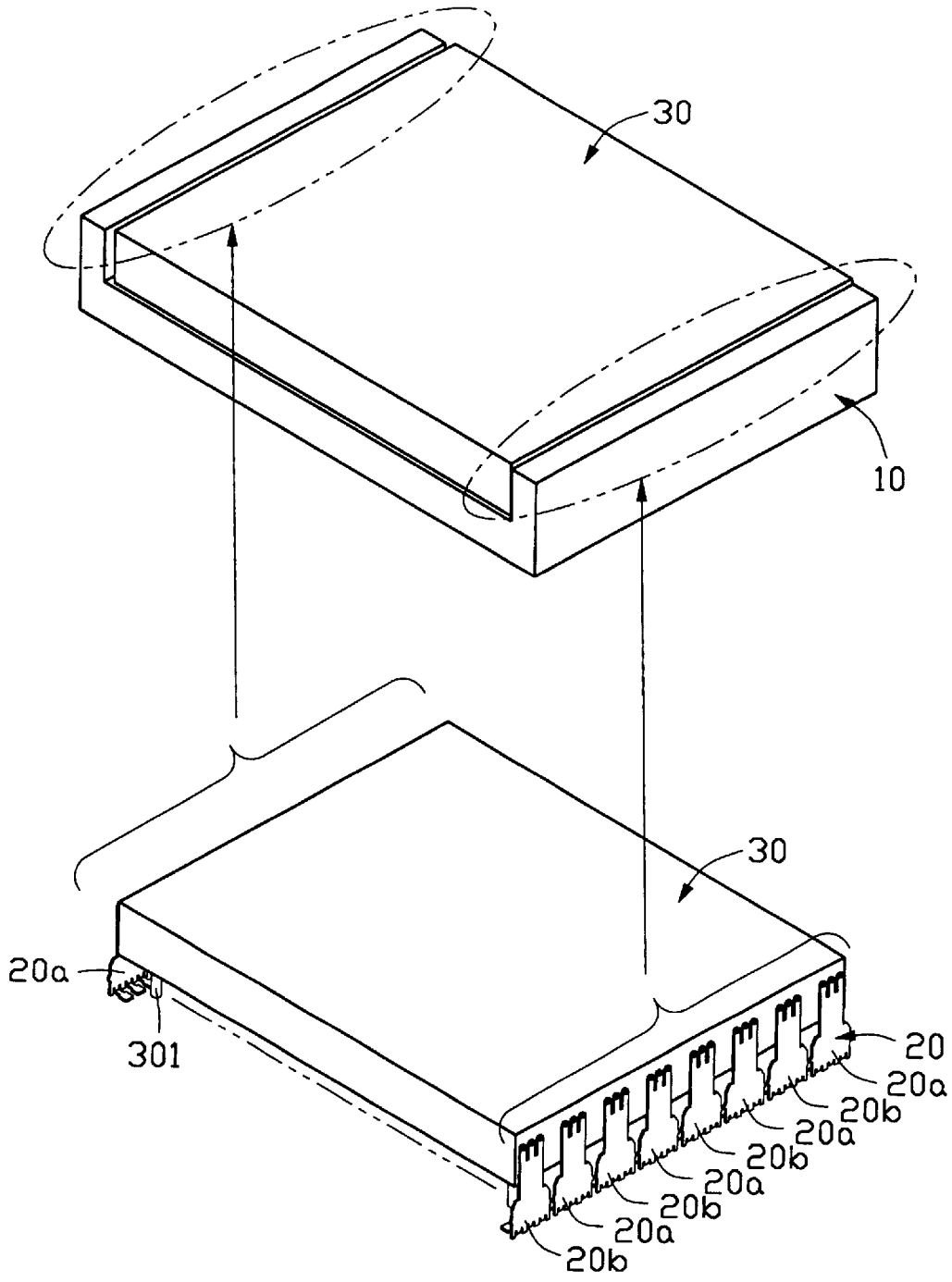
FIG. 5 is a view showing the staggered arrangement of current contacts and grounding contacts on the same side of an integrated circuit package having the same height for engaging with corresponding conductive spots in accordance with the first embodiment of the present invention.
Figure 6:
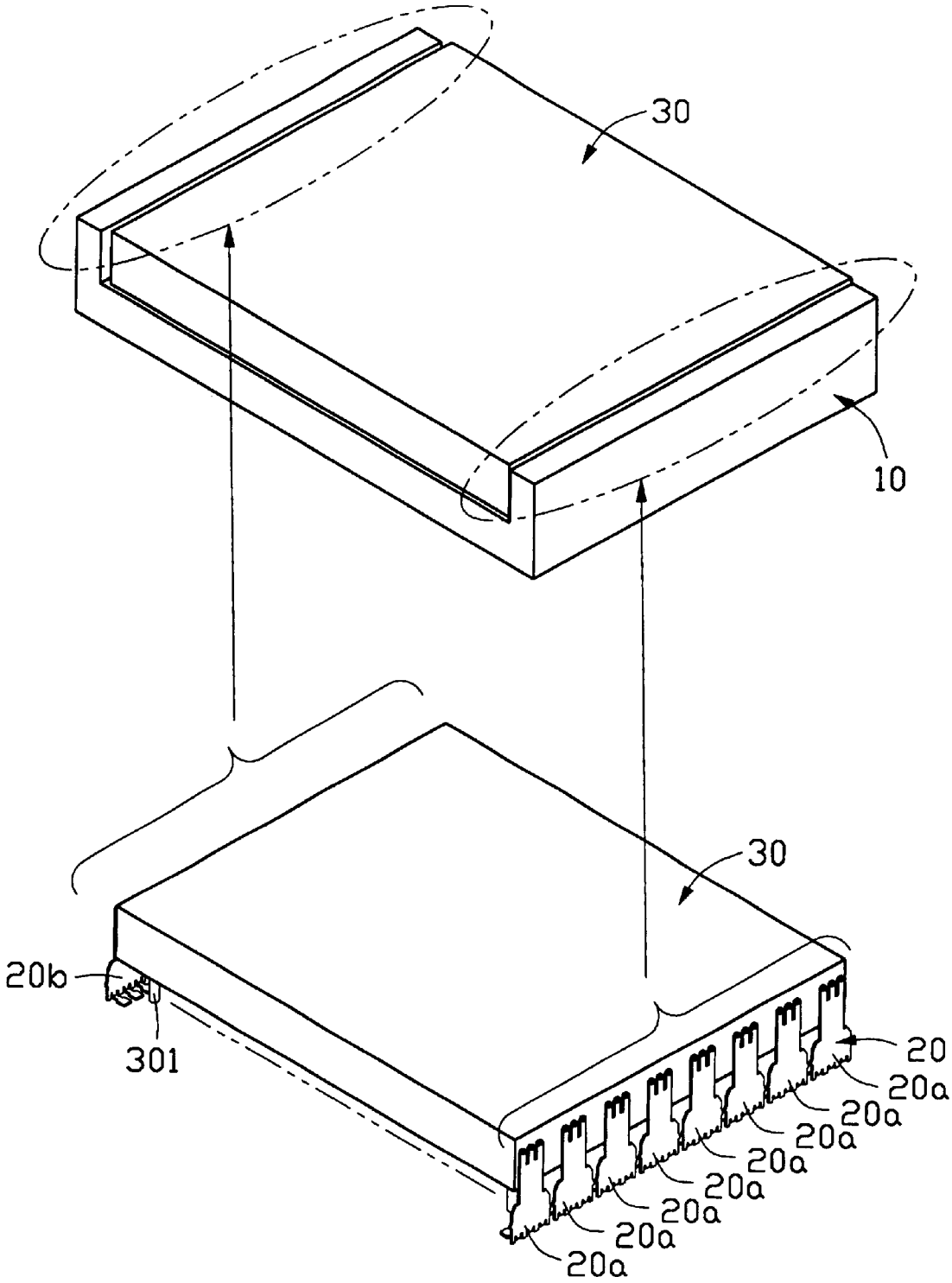
FIG. 6 is a view showing the arrangement of the current contacts on one side and the grounding contacts on the other side of the integrated circuit package in accordance with a second embodiment of the present invention.

There are several ways of setting the side contacts 20 on the sides of the integrated circuit package 30. FIG. 5 shows the first embodiment of the present invention in which the side contact 20 includes current contact 20*a* and grounding contact 20*b* of the same height that are staggered on the same side of the integrated circuit package 30. Referring to FIG. 6, the current contacts 20*a* and grounding contacts 20*b* can also be provided on different sides of the sidewalls 101 of the base 10.

Figure 7:
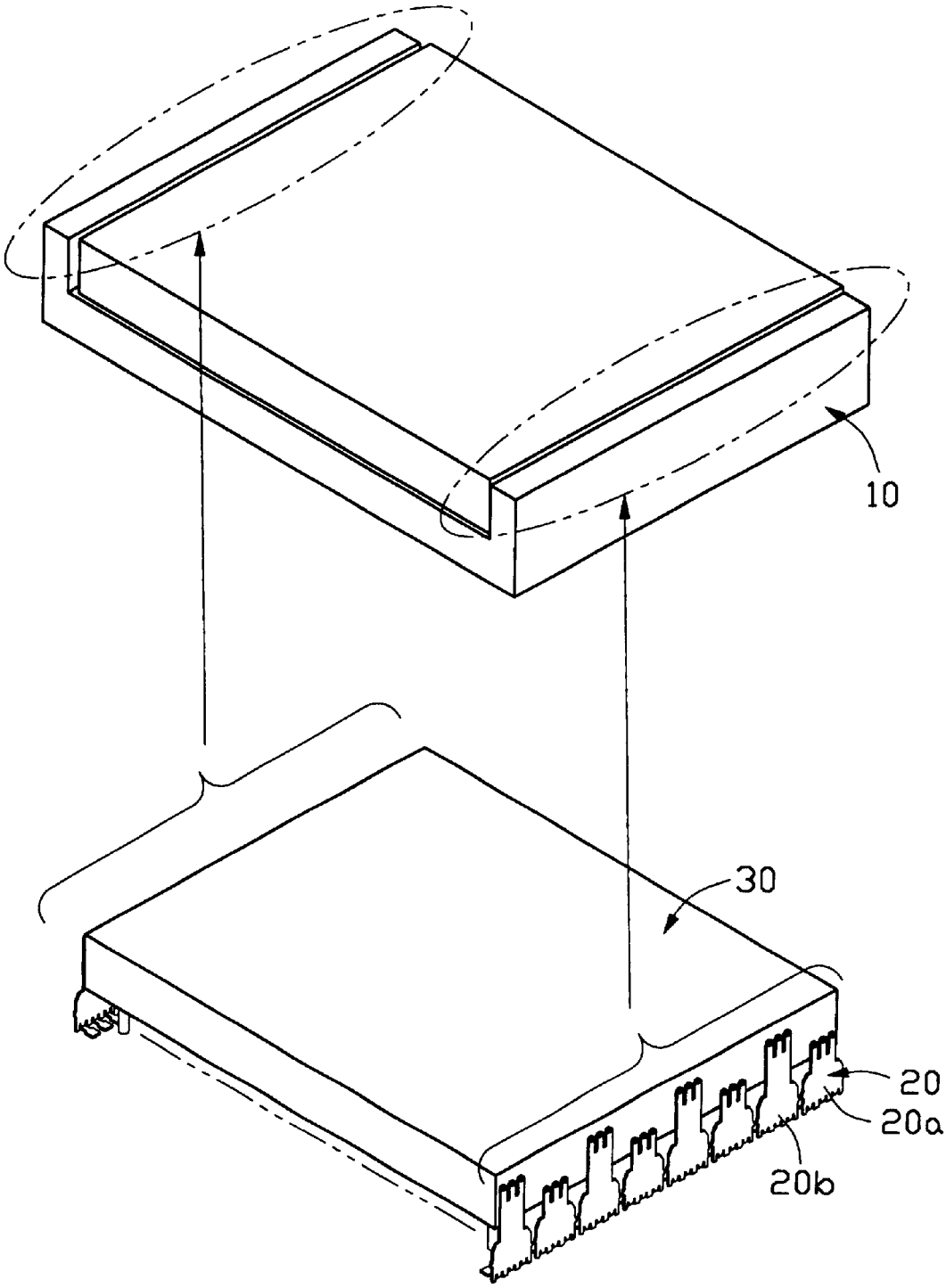
FIG. 7 is a view showing that the current contacts and the grounding contacts have different height for engaging with corresponding conductive spot in accordance with a third embodiment of the present invention.
Figure 8:
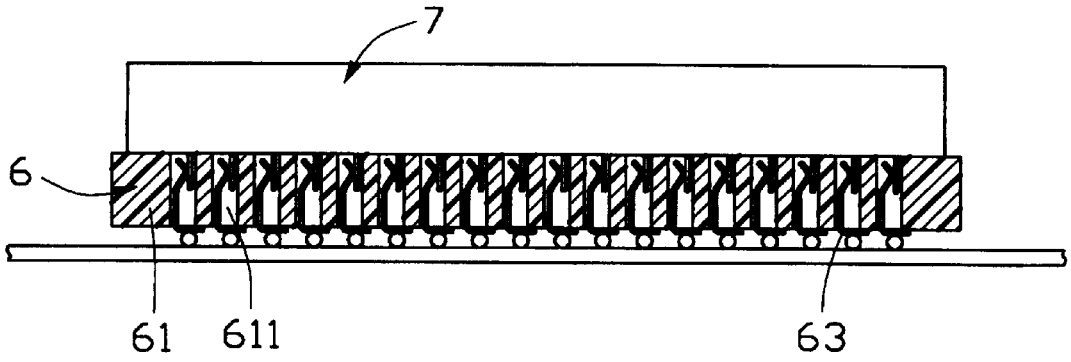
FIG. 8 (PRIOR ART)
FIG. 8 is a cross sectional view of a prior art high current capacity socket.

Referring to FIG. 7, the side contacts 20 have different height to differentiate the current contacts 20*a* from the grounding contacts 20*b*. The current contacts 20*a* have a smaller height than the grounding contacts 20*b* and are staggered on the same side of the integrated circuit package 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high current capacity socket for receiving an integrated circuit package having a plurality of conductive spots exposed at a side thereof and a plurality of pins extending downwardly, comprising:

a base having a bottom plate, a plurality of passageways defined in the bottom plate for receiving the pins and a sidewall extending upwardly from the bottom plate; and a plurality of side contacts secured to the sidewall for engaging with conductive spots of an integrated circuit package mounted to the base.

2. The high current capacity socket as claimed in claim 1, wherein the side contacts are insert molded on the sidewall.

3. The high current capacity socket as claimed in claim 2, wherein the side contacts include current contacts and grounding contacts.

4. The high current capacity socket as claimed in claim 3, wherein the base further comprises another sidewall extending from the bottom plate and situated opposite to said sidewall.

5. The high current capacity socket as claimed in claim 4, wherein the current contacts and the grounding contacts are staggered on the same sidewall.

6. The high current capacity socket as claimed in claim 4, wherein the current contacts and the grounding contacts are positioned on different sidewalls.

7. The high current capacity socket as claimed in claim 6, wherein the current contacts and the grounding contacts have different height.

8. The high current capacity socket as claimed in claim 1, wherein each of the side contacts has a connecting portion and a plurality of finger-like arms extending from the connecting portion to increase the number of contact points to reduce interface resistance.

9. The high current capacity socket as claimed in claim 8, wherein each of the arms defines a dimple at a top end thereof to increase Hertz stress to reduce interface resistance.

10. The high current capacity socket as claimed in claim 9, wherein the side contact has a plurality of solder pads extending from the connecting portion in a direction opposite to the finger-like arms.

11. A socket for use with an integrated circuit package, comprising:

an insulative base defining a bottom plate and at least one side wall extending upwardly on one side of said bottom plate;

a plurality of first terminal assemblies positioned in the bottom plate and arranged in a matrix for communication with said integrated circuit package in a vertical direction; and a plurality of second terminal assemblies positioned on the side wall for communication with said integrated circuit package in a horizontal direction.

12. The socket as claimed in claim 11, wherein another side wall with a plurality of either said second terminal assemblies or third terminal assemblies, are disposed upwardly on anther side of said bottom plate opposite to said side wall in said horizontal direction.

13. The socket as claimed in claim 11, wherein said bottom plate and said side wall are integrally formed as one piece.

14. A socket assembly comprising:

an insulative base defining a bottom plate;

a plurality of signal contacts disposed in the bottom plate and arranged in a matrix;

a plurality of power/grounding contacts disposed around at least a part of a periphery of said matrix;

an integrated circuit package positioned on said base, said package including an insulative housing with a plurality of signal conductors disposed on a bottom face thereof in contact with the corresponding signal contacts, respectively, and with a plurality of power/grounding conductors disposed on at least a side face thereof in contact with the corresponding power/grounding contacts, respectively.

15. The assembly as claimed in claim 14, wherein said power/grounding contacts are disposed in a side wall of the base, said side wall being positioned on one side of said bottom plate.

16. The assembly as claimed in claim 15, wherein said side wall is integrally formed with the bottom plate.

17. A method of electrically interconnecting an integrated circuit package and a socket, comprising the steps of:

providing an insulative socket with a bottom plate;

disposed a plurality of signal contacts in the bottom plate;

providing a plurality of power/grounding contacts by one side of said signal contacts; and disposed an integrated circuit package on said socket with a plurality of signal conductors, which are formed on a bottom face of the package, in contact with the corresponding signal contacts, and also with a plurality of power/grounding conductors, which are formed on at least one side face of the package, in contact with the corresponding power/grounding contacts.

18. The method as claimed in claim 17, wherein the signal conductors communicate with the corresponding signal contacts in a vertical direction while the power/grounding conductors communicate with the corresponding power/grounding contacts in a horizontal direction.

19. The method as claimed in claim 17, wherein the base further includes a side wall on which the power/grounding contacts are located.

* * * * *